US008186765B2

(12) United States Patent
Kwon et al.

(10) Patent No.: US 8,186,765 B2
(45) **Date of Patent: *May 29, 2012**

(54) METHOD OF MANUFACTURING TOOTHBRUSH WITH NEEDLE-SHAPED BRISTLES, AND TOOTHBRUSH MANUFACTURED BY THE SAME

(75) Inventors: Young-Jun Kwon, Gyunggi-do (KR); Sung-Wook Kwon, Seoul (KR); Sung-Hwan Kwon, Seoul (KR)

(73) Assignee: Best Whasung Co., Ltd., Gyunggi-Do (KR)

( * ) Notice: Subject to any disclaimer, the term of this patent is extended or adjusted under 35 U.S.C. 154(b) by 1009 days.

This patent is subject to a terminal disclaimer.

(21) Appl. No.: 11/915,725

(22) PCT Filed: Jun. 8, 2005

(86) PCT No.: PCT/KR2005/001707

§ 371 (c)(1),
(2), (4) Date: Feb. 15, 2008

(87) PCT Pub. No.: WO2006/129895

PCT Pub. Date: Dec. 7, 2006

(65) Prior Publication Data

US 2008/0197693 A1 Aug. 21, 2008

(30) Foreign Application Priority Data

Jun. 3, 2005 (KR) ..... 10-2005-0047757

(51) Int. Cl.
*A46D 1/00* (2006.01)
*A46D 9/00* (2006.01)

(52) U.S. Cl. ..... 300/21; 300/2

(58) Field of Classification Search ..... 300/2, 21; 15/167.1, 207.2
See application file for complete search history.

(56) References Cited

U.S. PATENT DOCUMENTS

| | | | | |
|---|---|---|---|---|
| 5,533,227 | A * | 7/1996 | Ito et al. | 15/167.1 |
| 5,778,476 | A | 7/1998 | Squillaci | |
| 5,991,957 | A * | 11/1999 | Watanabe | 15/167.1 |
| 6,090,488 | A * | 7/2000 | Kweon | 428/399 |
| 2002/0116778 | A1 * | 8/2002 | Kwon | 15/167.1 |

FOREIGN PATENT DOCUMENTS

| | | |
|---|---|---|
| JP | 61-16701 | 1/1986 |
| JP | 7-213346 | 8/1995 |
| JP | 12-14447 | 1/2000 |

* cited by examiner

*Primary Examiner* — Randall Chin
(74) *Attorney, Agent, or Firm* — Egbert Law Offices PLLC

(57) ABSTRACT

The present invention provides a method of manufacturing a toothbrush having needle-shaped bristles and a toothbrush manufactured using the method. The method of the present invention includes the step of grinding bristles, which have been set in a head part of a toothbrush, using a grinder provided with protrusions (11) having heights ranging from 1.5 mm to 7 mm. According to the manufacturing method of the present invention, a toothbrush having needle-shaped bristles can be manufactured without a separate chemical immersion process such that the thicknesses of the end points of the needle-shaped bristles range from 0.01 mm to 0.03 mm and the lengths of the tapered portions thereof range from 3 mm to 9 mm. Furthermore, because the process is simplified, the time required for production and the defective proportion is markedly reduced. As well, in the present invention, materials other than polyester can be used as the material for the bristles, unlike the conventional arts, in which this is impossible.

18 Claims, 5 Drawing Sheets

[Fig. 1]
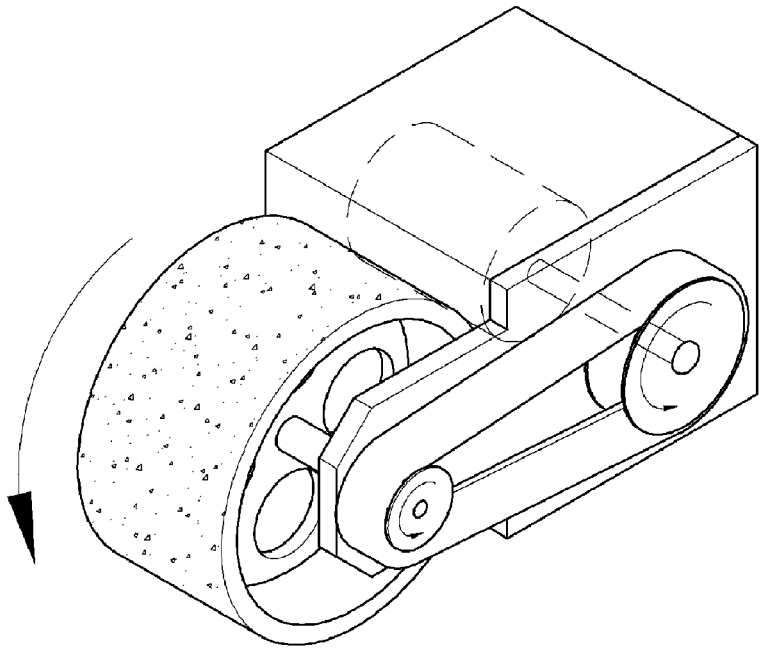
[Fig. 2]
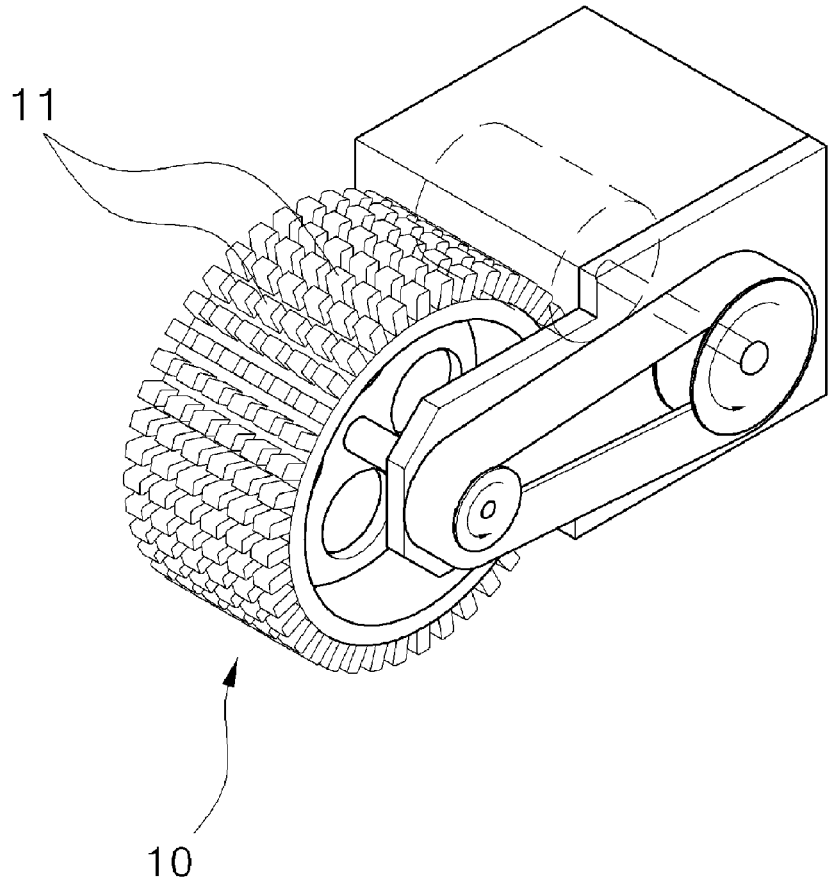

[Fig. 3]
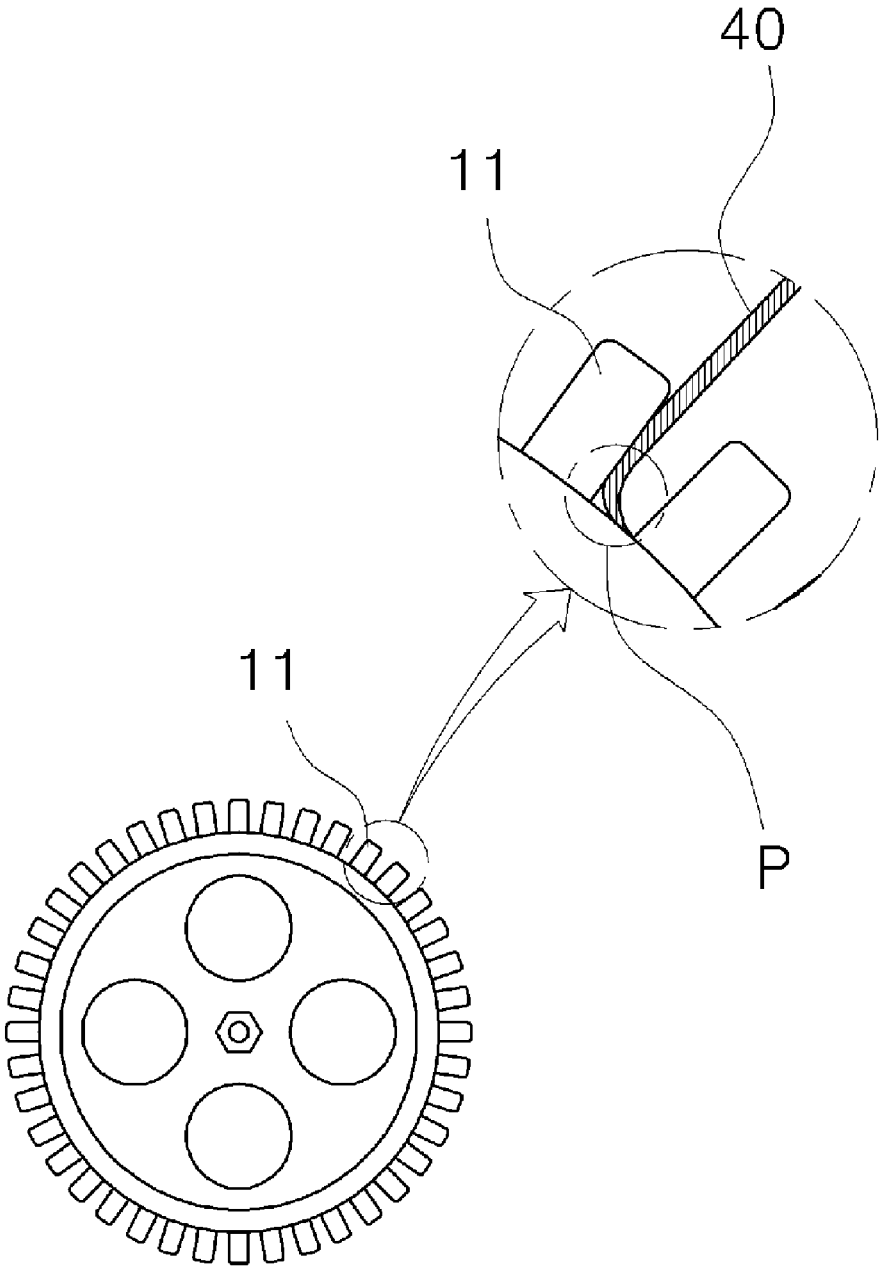

[Fig. 4]
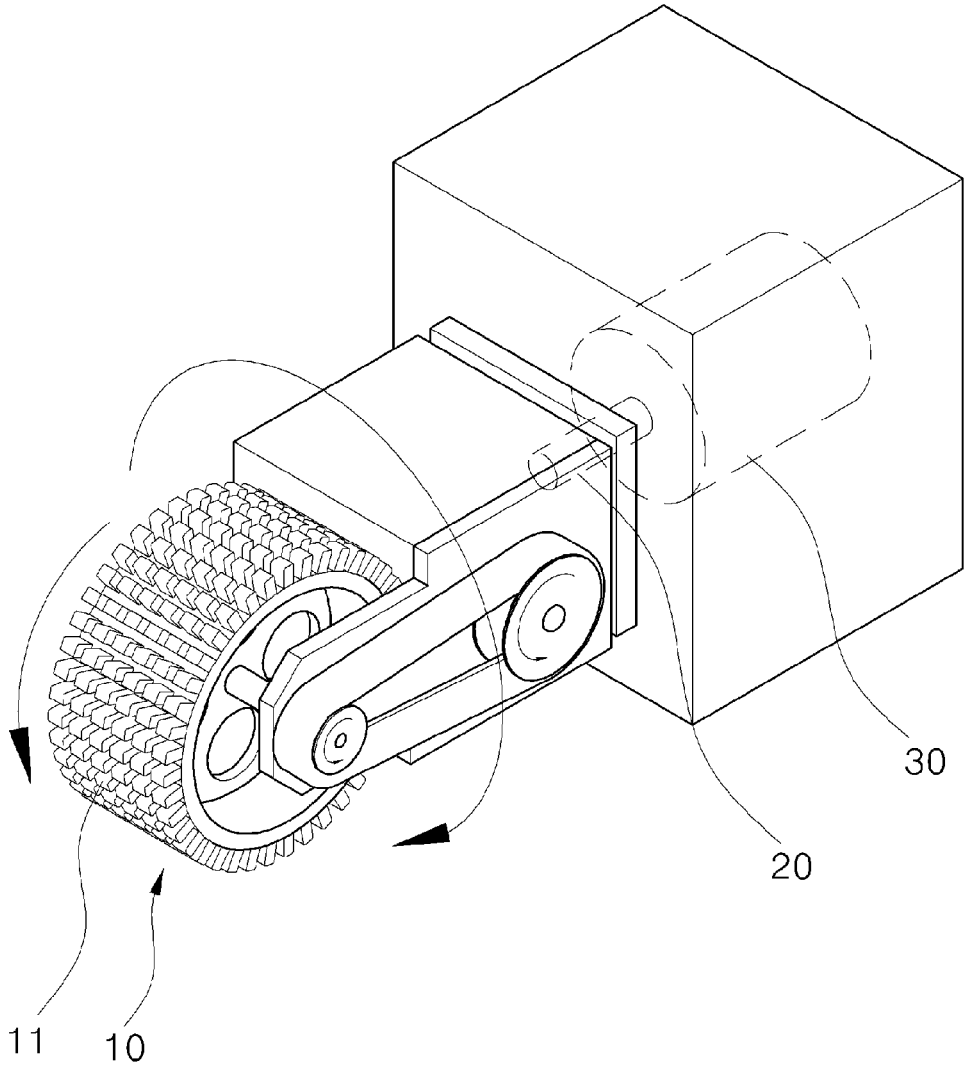
[Fig. 5]
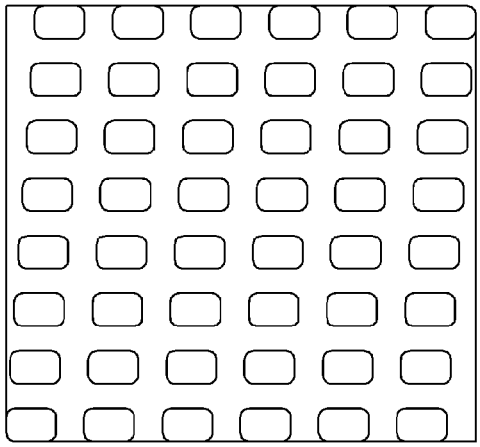

[Fig. 6]
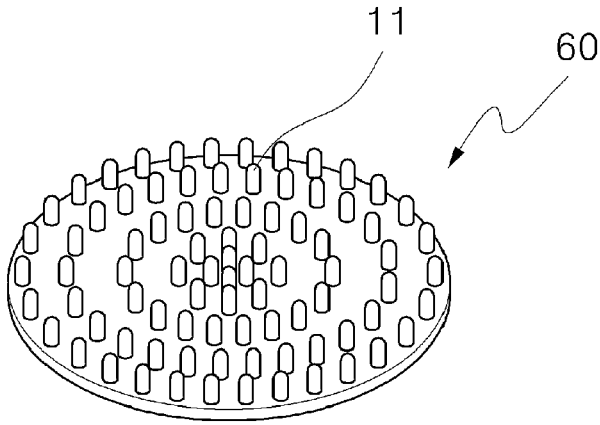
[Fig. 7]
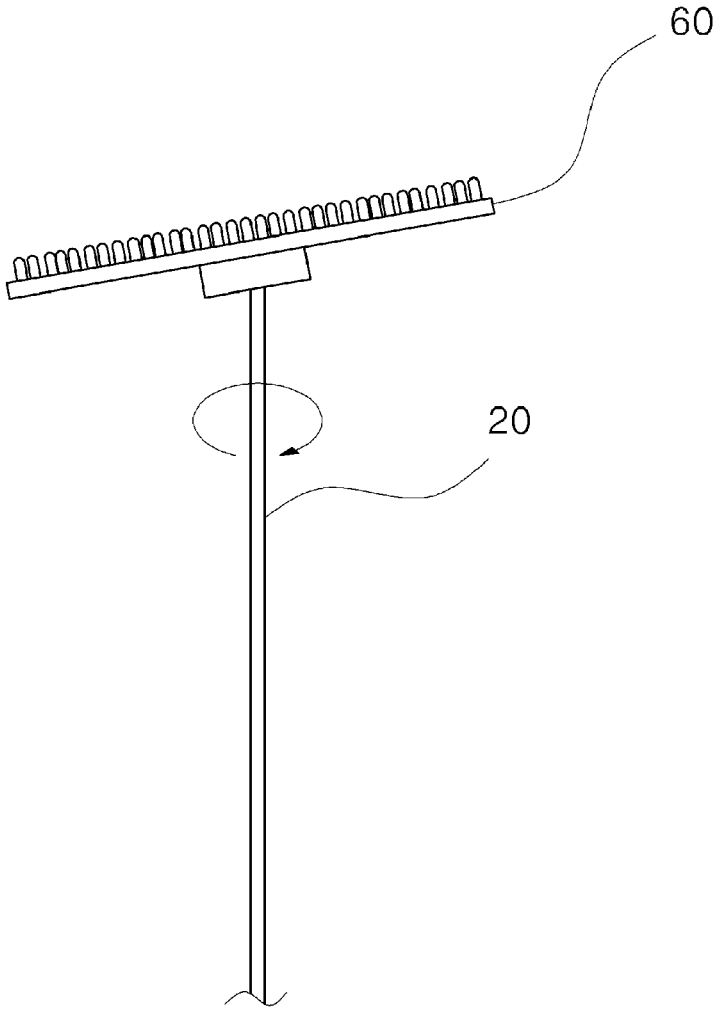

[Fig. 8]
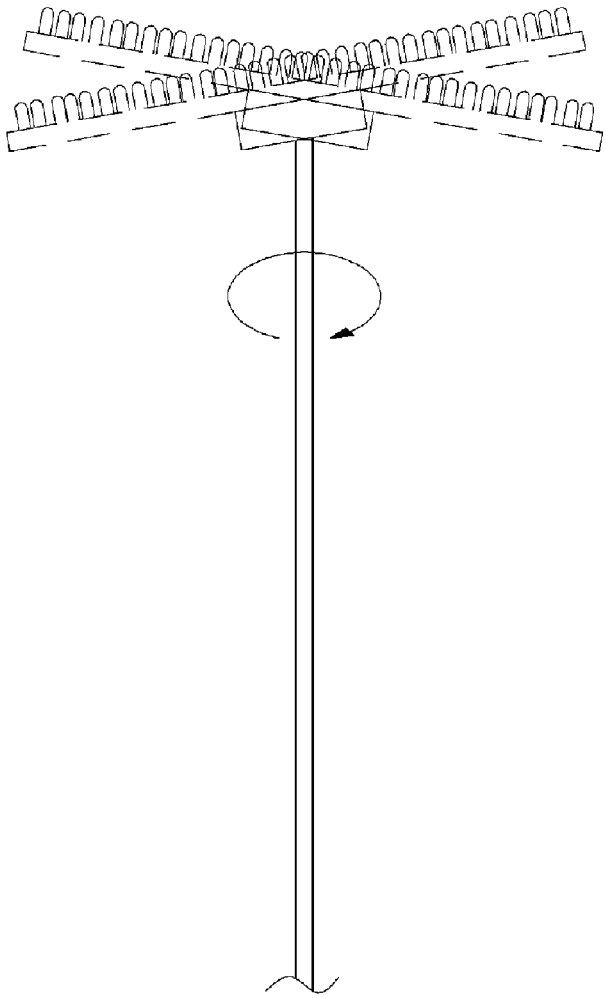
[Fig. 9]
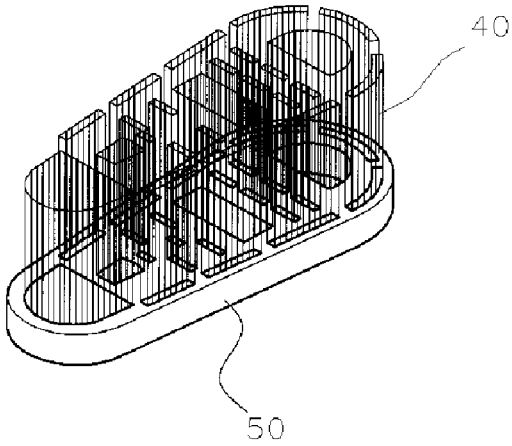

METHOD OF MANUFACTURING TOOTHBRUSH WITH NEEDLE-SHAPED BRISTLES, AND TOOTHBRUSH MANUFACTURED BY THE SAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates, in general, to methods of manufacturing toothbrushes having needle-shaped bristles and toothbrushes manufactured using the methods and, more particularly, to a method of manufacturing a toothbrush having needle-shaped bristles without conducting a chemical treatment process, and a toothbrush manufactured using the method.

2. Description of Related Art Including Information Disclosed Under 37 CFR 1.97 and 37 CFR 1.98

Generally, needle-shaped bristles, which have sharp ends and are set in a toothbrush, have superior flexibility and ability to penetrate into gaps between teeth or into periodontal pockets, compared to normal bristles, end points of which are round. Thus, recently, needle-shaped bristles have been set in almost all high quality toothbrushes.

In methods of manufacturing such needle-shaped bristles, there are a method (i) in which end points of bristles are dissolved using a strong alkali chemical or strong acid chemical, a method (ii) in which bristles are ground using a grinder after a bristle setting process has been conducted, and a method (iii) in which bristles are first partially tapered using the method (i) and are then additionally ground using the method (ii) after a bristle setting process has been conducted. Here, the term "previous partial tapering" means that the bristles are partially tapered such that the end points of the bristles have thicknesses ranging from 0.03 mm to 0.10 mm.

High quality needle-shaped bristles, which are tapered such that the length of the tapered portions of the bristles is relatively long, that is, 5 mm or longer, and the thickness of end points of the bristles are approximately 0.01 mm, can be produced through the method (i). Because the tapered portions of these needle-shaped bristles are relatively long, the flexibility thereof increases. Furthermore, the end points of the bristles are relatively thin, so that the penetration ability is superior. However, it is very difficult to adjust the precise time required to dissolve the bristles. As well, there is a problem of an increase in the number of defective products.

In the case of the method (ii), the workability is increased, but because tapered portions of produced needle-shaped bristles are relatively short, that is, 2 mm, the flexibility is poor. As a result, there is a problem of damage to the gums of a user.

The method (iii) is advantageous in that it solves some problems of the methods (i) and (ii). This method (iii) was proposed in Korean Patent No. 261658 and No. 421454 which were filed by the inventor of the present invention. Korean Patent No. 261658 proposes a method, in which bristles are immersed and dissolved in strong acid chemical or strong alkali chemical until just before the length of the bristles is reduced and, thereafter, the partially tapered bristles are washed in water and dried, and then set in a head part of a toothbrush after being ground using a grinder. The needle-shaped bristles produced by this method are relatively long, that is, approximately 5 mm, so that the flexibility thereof is superior. However, because the thickness of the end points of the bristles ranges from 0.04 mm to 0.08 mm, that is, because the thickness of the end points is relatively large, the penetration ability is poor. If the grinding process is further conducted to reduce the thickness of the end points of the bristles, the length of the tapered portions of the bristles is reduced, thus resulting in poor flexibility.

Korean Patent No. 421454 is similar to Korean Patent No. 261658. In this case, bristles are ground such that the thickness of end points of bristles is 0.02 mm or less in order to enhance the penetration ability. However, this case is problematic in that, because the length of tapered portions of the bristles ranges from 2.8 mm to 3.5 mm, the flexibility is poor. Furthermore, there is a problem in that the number of defective products increases in a manufacturing process.

That is, it has been very difficult to produce needle-shaped bristles having both increased penetration ability and flexibility through the conventional immersion and grinding processes. Meanwhile, to solve the above problem, in Korean Patent Application No. 2004-0103171, which was filed by the inventor of the present invention, a toothbrush manufacturing method, in which bristles are partially tapered through a chemical immersion process and are set in a head part of a toothbrush and, thereafter, the bristles set in the toothbrush are ground using a drum grinder provided with protrusions having heights ranging from 2 mm to 10 mm, was proposed. The thicknesses of end points of the bristles manufactured by this method range from 0.01 mm to 0.03 mm, and the lengths of tapered portions of the bristles range from 3.5 mm to 8 mm.

This method can be applied to polyester bristles, which can be dissolved through the chemical immersion process, but cannot be applied to nylon, polyolefin or acryl bristles, which are not dissolved by a chemical. Furthermore, there is a problem in that the chemical immersion process must be conducted.

BRIEF SUMMARY OF THE INVENTION

Technical Problem

Accordingly, the present invention has been made keeping in mind the above problems occurring in the prior art, and an object of the present invention is to provide a toothbrush having needle-shaped bristles that have improved penetration ability and flexibility and are manufactured without a chemical immersion process. Another object of the present invention is to provide a method of manufacturing a toothbrush having needle-shaped bristles which can be used to manufacture non-polyester bristles as well as polyester bristles. A further object of the present invention is to provide a method of manufacturing toothbrush having needle-shaped bristles in which a manufacturing process is simple and the defective proportion is markedly reduced.

Technical Solution

In the present invention, a toothbrush is manufactured by a method, in which general bristles are set in a head part of a toothbrush and are then ground using a grinder provided with protrusions having heights ranging from 1.5 mm to 7 mm. The thicknesses of end points of the bristles of the toothbrush manufactured by the method of the present invention range from 0.01 mm to 0.03 mm, and the lengths of tapered portions of the bristles range from 3 mm to 9 mm.

Advantageous Effects

As described above, according to a toothbrush manufacturing method of the present invention, a toothbrush having needle-shaped bristles can be manufactured without a chemical immersion process regardless of the material of bristles. Furthermore, because no chemical immersion process is necessary, working conditions are markedly improved, and effluent is fundamentally prevented from being generated. As well, residual pieces and dust created from the bristles in a grinding process can be reused.

BRIEF DESCRIPTION OF THE SEVERAL VIEWS OF THE DRAWINGS

FIG. 1 is a perspective view showing a conventional drum grinder.

FIG. 2 is a perspective view of a drum grinder having a plurality of protrusions, according to the present invention.

FIG. 3 is a front elevation view showing an example of the shape of the protrusions of the drum grinder according to the present invention.

FIG. 4 is a perspective view of the drum grinder coupled to a rotor, according to the present invention.

FIG. 5 is a front elevation view showing the offset arrangement of the protrusions of the drum grinder according to the present invention.

FIG. 6 is a perspective view of a disk grinder according to the present invention.

FIG. 7 is a side elevation view showing the disk grinder coupled to a rotating shaft according to the present invention.

FIG. 8 is a side elevation view showing rotation of the disk grinder according to the present invention.

FIG. 9 is a perspective view of a head insert, in which bristles are set, according to the present invention.

Description of the elements in the drawings

10: drum having protrusions
11: protrusions
20: rotating shaft
30: rotor
40: bristles
50: head insert having bristles
60: grinding disk
P: bent part

DETAILED DESCRIPTION OF THE INVENTION

Hereinafter, the present invention will be described in detail.

A typical grinder has the structure shown in FIG. 1. The surface of the grinder is coated with grind stones such as diamonds. This drum grinder has a planar surface and grinds an object by rotating. The patents filed by the inventor of the present invention disclose the same kind of grinders, and these grinders grind bristles which were previously partially tapered using a chemical. However, if the bristles are not previously partially tapered using a chemical, it is very difficult to produce needle-shaped bristles, end points of which have a thickness of 0.03 mm and tapered portions of which have a length of 3.5 mm, using the above-mentioned grinders. The reason is that, if bristles are heavily ground by a grinder in order to reduce the thickness of the end points of the bristles, the length of tapered portions of the bristles is excessively reduced, and, conversely, if the bristles are ground such that the length of tapered portions is maintained within a desired range, the thickness of the end points is increased.

As shown in FIG. 2, a grinder used in a toothbrush manufacturing method of the present invention has a plurality of protrusions 11 thereon. The height of each protrusion ranges from 1.5 mm to 7 mm and, more preferably, may be appropriately set within the range from 2 mm to 10 mm. If the heights of the protrusions are less than the above range, the lengths of tapered portions of bristles are reduced. If the heights of the protrusions are greater than the above range, the thicknesses of end points of the bristles are increased above a desired range.

For example, in the case where the lengths of the protrusions 11 are 7 mm, about 2 mm of the end of each bristle is bent and is finely ground by grinding parts exposed between protrusions 11, and a portion of each bristle which is spaced apart from the end thereof by a distance ranging from 2 mm to 7 mm is relatively slightly ground by side surfaces of the protrusions 11 (see, FIG. 3). In this case, the thicknesses of the end points of the manufactured needle-shaped bristles range from 0.01 to 0.03 mm. The lengths of the tapered portions of the needle-shaped bristles are about 7 mm. It is appropriate that the distance between adjacent protrusions 11 range from 1 mm to 5 mm and, more preferably, range from 2 mm to 3 mm. If the distance between adjacent protrusions 11 is greater than this range, workability is reduced. If the distance between adjacent protrusions 11 is less than this range, it is difficult to manufacture the grinder. The shape of each protrusion 11 is not limited to a particular shape, but it is preferable that the protrusion 11 have a mountain top shape or a cylindrical or hexahedral shape, upper and lower portions of which have the same cross-section.

The surface of each protrusion 11 is coated with grind stones in the same manner as a conventional grinder. The grinder may be constructed such that the grind stones are embedded in the surface of the grinder. When the grinder having the protrusions 11 rotates for a predetermined time and then rotates in reverse, satisfactory bristles can be obtained. Furthermore, needle-shaped bristles may be obtained through a method in which several grinders having protrusions are sequentially arranged such that a first grinder rotates in a predetermined direction and a sequent grinder rotates in the opposite direction, so that objective bristles are consecutively ground by the several grinders for a predetermined time.

However, to obtain more satisfactory bristles, a grinder which is also able to rotate in a transverse direction is required. A grinder having this structure is shown in FIG. 4. In this drawing, the drum grinder, having protrusions 11, is coupled to a rotating shaft 20 of a rotor 30. The rotor 30 rotates in a transverse direction while the grinder rotates in a longitudinal direction. In the case of the grinder which is able to rotate in both longitudinal and transverse directions, the entire grinder is evenly involved in a grinding operation, compared to a grinder which is able to rotate in only one direction. As a result, the grinder is prevented from being unevenly worn, so that its expected life span is extended. Furthermore, because the grinder can evenly grind bristles, the time required to finish the tapering process is reduced.

In the case where a drum grinder is used, as shown in FIG. 5, when the protrusions 11 are not arranged parallel to the direction in which the grinder rotates, but form a spiral inclination in a manner similar to the formation of a thread of a screw, the grinding efficiency of the grinder is increased. The reason for this is that, in the case where the protrusions of the drum grinder has the above-mentioned arrangement, bristles contact a larger number of protrusions 11 during a grinding process.

To further increase the grinding efficiency, the grinder or objective bristles may reciprocate forwards and backwards within a range from 1 mm to 3 mm during a grinding process. In this case, the efficiency of grinding bristles is further increased, and a portion P of FIG. 3, that is, bent portions of bristles, can be ground more reliably.

In the present invention, as well as the drum grinder of FIG. 2, a disk grinder may be used, as shown in FIG. 6. In the disk grinder, the heights of protrusions 11 and the distance between adjacent protrusions 11 are equal to those of the drum grinder. In the case of using the disk grinder, to enhance the grinding efficiency, a grinding disk 60 may be coupled to a rotating shaft 20 such that the grinding disk 60 is inclined at an angle ranging from 15° to 60°, as shown in FIG. 7. Due to this coupling structure, the disk grinder rotates in a manner similar to when a top rotates just before it falls over (see, FIG. 8).

In a manufacturing method according to another embodiment of the present invention, bristles are held by a bristle carrier and are ground using a drum grinder having protrusions 11 before being set in a head part of a toothbrush. The term "bristle carrier" means a unit that selects some bristles from a bundle of tied bristles and carries them to a bristle setting machine.

In a manufacturing method according to another embodiment of the present invention, as shown in FIG. 9, a head insert, in which bristles are set using an AFT anchorless bristle setting machine, is coupled to a toothbrush after the bristles are ground using a drum grinder having protrusions 11.

Meanwhile, in the present invention, the material for the bristles to be set is not limited to any particular material. In detail, in the conventional art, because bristles cannot be tapered to the desired degree using a mechanical method, polyester bristles, which can be dissolved by an alkali or acid chemical, are first partially tapered and, thereafter, are completely tapered through a mechanical grinding process. As such, in the conventional art, only polyester bristles can be used. However, in the present invention, because a tapering process is conducted only using a mechanical method, bristles made of material, such as nylon, polyolefin and acryl, which are not dissolved by an alkali chemical or acid chemical, can also be used.

Furthermore, as necessary, several of the above kinds of non-polyester bristles may be combined, and polyester bristles and non-polyester bristles may be combined. In the conventional art, in the case that polyester bristles and non-polyester bristles are combined, because it is impossible to taper the non-polyester bristles, the polyester bristles are tapered, but the non-polyester bristles are directly set in the toothbrush without being tapered.

As well, as necessary, bristles which are relatively long and bristles which are relatively short may be set together in a toothbrush and be processed by a grinding treatment. In this case, tapered portions of the long bristles are relatively long while tapered portions of the short bristles are relatively short. Therefore, the long bristles have superior penetration ability and thus serve to remove food residue held between teeth, and the short bristles have improved cleaning ability and thus serve to remove tartar from teeth. In a manner similar to the above description, various kinds of bristles having different diameters may be combined. A toothbrush, which is manufactured by this method, also has superior penetration ability and improved cleaning effects, because it has various bristles, end points of which are different.

Several examples according to the present invention are as follows.

Example 1

Ten drum grinders, each of which has protrusions 11 that are 4 mm high and are spaced apart from each other at intervals of 3 mm, were disposed adjacent to each other. At the leftmost position, a first grinder, in which the surfaces of protrusions 11 and the surface between the protrusions 11 were evenly coated with grind stones of 200 mesh, was disposed, and the remaining grinders, which were respectively coated with grind stones of 230, 320, 320, 550, 550, 600, 650 and 650 mesh, were consecutively arranged in a line.

Typical polyester bristles, which have not been tapered, were set in a toothbrush body and, thereafter, the set polyester bristles were consecutively moved from the first grinder to the last grinder and were thus ground by the grinders. Each grinder spun at 3000 rpm and was used to grind the bristles for three seconds.

As a result, the lengths of the tapered portions of bristles of the manufactured toothbrush ranged from 5 mm to 6 mm. The thicknesses of the end points of the bristles range from 0.02 mm to 0.03 mm.

Example 2

The second example was conducted in the same method as the first example, but using grinders of FIG. 4, which are able to rotate in both longitudinal and transverse directions. Here, the longitudinal rotating speed was 3000 rpm, the same as in the first example, and the transverse rotating speed was 600 rpm. The time required to grind bristles was two seconds. In this case, the thicknesses of the end points of the bristles of the manufactured toothbrush ranged from 0.01 mm to 0.02 mm. The lengths of the tapered portions of the needle-shaped bristles ranged from 5 mm to 7 mm.

Example 3

The third example was conducted in the same method as the first example, but using disk grinders of FIG. 7 and increasing the time for which each grinder ground bristles to four seconds. As a result, the lengths of the tapered portions and the thicknesses of end points of bristles of the manufactured toothbrush were equal to those of the first example.

Example 4

The fourth example was conducted in the same method as the second example, but using nylon bristles (Tynex™ 8 mils of Dupont Company). In this case, the lengths of the tapered portions and the thicknesses of end points of bristles of the manufactured toothbrush were equal to those of the second example.

Example 5

The fifth example was conducted in the same method as the second example, but combining polyester bristles and nylon bristles. In this case, the lengths of the tapered portions and the thicknesses of end points of bristles of the manufactured toothbrush were equal to those of the second example.

Comparative Example

This example was conducted in the same method as the second example, but using a typical drum grinder having no protrusion. As a result, the thicknesses of the end points of the bristles of the manufactured toothbrush range from 0.02 mm to 0.03 mm. The lengths of the tapered portions of the needle-shaped bristles range from 1.5 mm to 2.5 mm.

We claim:

1. A method of manufacturing a toothbrush having needle-shaped bristles comprising:

providing a grinder having a plurality of protrusions thereon, said plurality of protrusions having heights ranging from 1.5 millimeters to 7 millimeters, said protrusions being spaced apart from each other by distances ranging from 1 millimeters to 5 millimeters; and grinding a set of non-tapered bristles with said grinder to form a set of the needle-shaped bristles.

2. The method of claim 1, further comprising:

setting said non-tapered bristles in a toothbrush body prior to the step of grinding.

3. The method of claim 1, further comprising:

setting said non-tapered bristles in a toothbrush head insert prior to the step of grinding.

4. The method of claim 3, further comprising:

coupling said toothbrush head insert to a toothbrush body after the step of grinding.

5. The method of claim 1, further comprising:

holding said non-tapered bristles in a bristle carrier prior to the step of grinding.

6. The method of claim 5, further comprising:

setting the needle-shaped bristles held in said bristle carrier in a toothbrush body after the step of grinding.

7. The method of claim 1, said grinder being a drum grinder, the step of grinding comprising:

rotating said drum grinder in a first direction about a central axis of said drum grinder during the step of grinding.

8. The method of claim 7, said drum grinder being coupled to a rotor, the method further comprising:

rotating said drum grinder with said rotor in a second direction transverse to said first direction during the step of grinding.

9. The method of claim 7, said plurality of protrusions forming a grid, said grid having a plurality of rows and a plurality of columns, said plurality of columns extending at an angle acute to said first direction.

10. The method of claim 1, the step of grinding further comprising:

reciprocating said grinder forward and backward for a distance of between 1 millimeters and 3 millimeters.

11. The method of claim 1, the step of grinding further comprising:

reciprocating the bristles forward and backward for a distance of between 1 millimeters and 3 millimeters.

12. The method of claim 1, wherein said grinder comprises a disk grinder coupled to a rotating shaft at an inclined or oblique angle.

13. The method of claim 1, wherein the distance between adjacent protrusions of said plurality of protrusions ranges between 2 millimeters and 3 millimeters.

14. The method of claim 1, the step of providing the grinder comprising:

coating said grinder with grind stones.

15. The method of claim 1, wherein said non-tapered bristles comprise polyester bristles.

16. The method of claim 1, wherein said non-tapered bristles comprise non-polyester bristles.

17. The method of claim 1, wherein said non-tapered bristles have different lengths.

18. The method of claim 1, wherein said non-tapered bristles have different diameters.

* * * * *